US005377473A

United States Patent [19]

Narayan et al.

[11] Patent Number: 5,377,473

[45] Date of Patent: Jan. 3, 1995

[54] INSULATING GLASS UNIT WITH INSULATIVE SPACER

[75] Inventors: Nilabh Narayan, Minneapolis; James E. Larsen, Andover, both of Minn.

[73] Assignee: Cardinal IG Company, Minnetonka, Mich.

[21] Appl. No.: 714,322

[22] Filed: Jun. 11, 1991

Related U.S. Application Data

[63] Continuation of Ser. No. 423,704, Oct. 16, 1989, abandoned, which is a continuation-in-part of Ser. No. 367,236, Jun. 16, 1989, abandoned.

[51] Int. Cl.[6] ..... E06B 7/12

[52] U.S. Cl. ..... 52/790; 52/788; 52/172

[58] Field of Search ..... 52/172, 788, 789, 790

[56] References Cited

U.S. PATENT DOCUMENTS

| | | | |
|---|---|---|---|
| 2,708,774 | 5/1955 | Seelen | 52/788 X |
| 3,921,359 | 11/1975 | Brichard et al. | 52/616 |
| 3,956,998 | 5/1976 | Bavetz | 52/481 |
| 3,981,111 | 9/1976 | Berthayen | 52/171 |
| 4,057,945 | 11/1977 | Kessler | 52/790 |
| 4,551,364 | 11/1985 | Davies | 52/172 |
| 4,576,841 | 3/1986 | Lingemann | 52/172 X |
| 4,658,553 | 4/1987 | Shinagawa | 52/788 X |
| 4,720,950 | 1/1988 | Bayer et al. | 52/790 |
| 4,780,164 | 10/1988 | Rueckheim et al. | 156/104 |
| 4,850,175 | 7/1989 | Berdan | 52/790 |

FOREIGN PATENT DOCUMENTS

| | | |
|---|---|---|
| 0139262 | 5/1985 | European Pat. Off. . |
| 2276450 | 1/1976 | France . |
| 2181773 | 4/1987 | United Kingdom . |

*Primary Examiner*—Carl D. Friedman
*Assistant Examiner*—Christopher Todd Kent
*Attorney, Agent, or Firm*—Fredrikson & Byron

[57] ABSTRACT

An insulating glass unit comprising a pair of generally parallel, spaced apart glass panes and a spacer-sealant assembly peripherally joining the glass panes to one another and defining with the glass panes a gas-containing interpane space. The spacer comprises a first web whose edges are joined to confronting surfaces of the glass panes by primary sealant strips, the first web and sealant providing a barrier having a permeance to air and interpane gas of not greater than about 0.06 cubic inches/year-inch-arm, and providing a first thermal path having a thermal resistance of not less than about 8 hr-°F.-ft/Btu. The unit is free from peripheral structure providing a separate parallel thermal path having a thermal resistance less than about two and one-half times that of the first thermal path.

9 Claims, 1 Drawing Sheet

PRIOR ART

INSULATING GLASS UNIT WITH INSULATIVE SPACER

This application is a continuation of application Ser. No. 423,704, filed Oct. 16, 1989, now abandoned, which is a continuation in part of application Ser. No. 367,236, filed Jun. 16, 1989, now abandoned.

FIELD OF THE INVENTION

The invention relates to insulating glass units for use in windows and doors.

BACKGROUND OF THE INVENTION

Insulating glass units commonly comprise two or more spaced, parallel glass panes, confronting surfaces of the panes being separated from one another by peripheral spacer(s). One or more of the confronting surfaces may be coated with metal oxides or other materials to improve thermal efficiency of the glass units. The spacers, which commonly are tubular lengths of metal, extend around the periphery of the glass panes and are sealed to confronting surfaces of the panes by means of relatively soft, adherent sealants.

From a structural standpoint, spacers must support pairs of glass panes with respect to one another against stresses resulting from positive or negative windload due to thunderstorms or major atmospheric disturbances and from temperature differentials in the glass panes. Organic sealants of the spacers referred to above generally are the weakest structural elements of the spacers and do not restrain glass panes from in-plane or bending movements; spacers employing organic sealants thus provide simply supported boundary conditions for the individual panes. Ceramic frit and other rigid spacers have been suggested in the prior art, and spacers of this type provide a rigid support approaching "clamped" boundary conditions. The probability of failure of glass panes under clamped boundary conditions from windload-induced stresses typically is much higher than that resulting from the use of simply supported boundary conditions, and clamped boundary conditions thus tend to require the use of thicker or tempered (and more costly) glass panes. The spacers also seal the interpane space (the space between confronting pane surfaces) from the atmosphere. The interpane space commonly contains dry air or an inert gas of low thermal conductivity, such as argon, and it is important that the interpane space be kept substantially free of moisture (which may condense) and even minute quantities of other contaminants.

In addition, spacers should be highly thermally insulative. The gas-filled interpane space offers excellent resistance to the flow of heat from an inner pane facing the interior of a building to the outer pane facing the outdoors. The bulk of the heat loss adjacent the periphery of insulating glass units occurs through the spacer because it is much more conductive to heat than is the gas in the interpane space. As a result, during wintertime conditions, the temperature of the inner pane peripheral area (usually considered to be a 2½ inch wide strip around the periphery of the pane), especially near the bottom of the units, may fall below the dew point of air adjacent the inner pane, causing undesirable condensation. The "sightline" (the distance from the edge of the glass pane to the inner edge of the spacer) should ideally be as small as possible to maximize the vision area, and sightlines often are required to be less than ¾ inches or even less than ½ inches. Thus, ideal spacers should allow the glass panes to bend while yet retaining excellent insulating qualities and resistance to gas transmission; yet, the spacers themselves should not unduly limit the viewing area.

To reduce the severity of the problems referred to above, various spacer designs have been investigated. There is yet a substantial and unfilled need for a durable spacer which provides reliable structural support between pairs of glass panes, which is substantially impermeable to moisture and gases, and which yet is highly insulative so as to strongly resist the flow of heat through the spacer from one pane to another.

SUMMARY OF THE INVENTION

The present invention provides a multipane insulating glass unit susceptible of mass production and comprising a pair of generally parallel, spaced apart glass panes and a spacer-sealant assembly peripherally joining the glass panes to one another and defining, with the panes, a gas-containing interpane space. The spacer-sealant assembly comprises a first web, preferably of metal, that substantially spans the distance between the panes, and a sealant sealing edges of the web to confronting surfaces of the panes, the first web and sealant providing a barrier having a permeance to air and the interpane gas of not greater than about 0.06 cubic inches/year-inch (of peripheral length)-atmosphere (and preferably less than 0.03 $in^3$/yr-inch-atm.). The first web and sealants provide between the panes (that is, between adjoining portions of confronting surfaces of the panes) a first thermal path extending through the web and having a thermal resistance of at least about 8 hr-°F.-ft/Btu, that is, 8 hr-°F./Btu per foot of length measured along the periphery of the panes. The glass unit is free of peripheral structure defining a thermal path in parallel with the first thermal path and having a thermal resistance less than about two and one-half times and preferably not less than about five times that of the first thermal path. The spacer-sealant assembly may include structural support means separate from the first web and structurally supporting the panes with respect to one another, the separate support means providing between the panes a second thermal path having a thermal resistance no less than about 2½ times and preferably no less than about five times that of the first thermal path.

The separate structural support means preferably comprises a second web that substantially spans the distance between the panes and provides a rigid structural support between the panes. The second web provides a second thermal path in parallel with the first thermal path, the second thermal path having a thermal resistance of at least about 24 hr-°F.-ft/Btu (peripheral) and preferably at least about 40 hr-°F.-ft/Btu. Desirably, the second web is spaced from the first web in the direction of (that is, closer to) the interpane space to define between the webs an elongated opening sealed from the exterior atmosphere by the first web, the second web having openings therethrough communicating the elongated opening with the interpane space. The openings through the second web desirably are sufficient in number, size and configuration to provide that web with the desired resistance to heat flow. In a preferred embodiment, the first and second webs desirably are integrally formed and define the exteriorly and interiorly facing walls of a tubular spacer, the edges of the spacer providing side walls joining the exteriorly and interiorly facing walls. The sealant, which may be a synthetic rubber, adheres the side walls of the spacer to the confronting surfaces of the panes.

DESCRIPTION OF THE PREFERRED EMBODIMENTS

Figure 1:
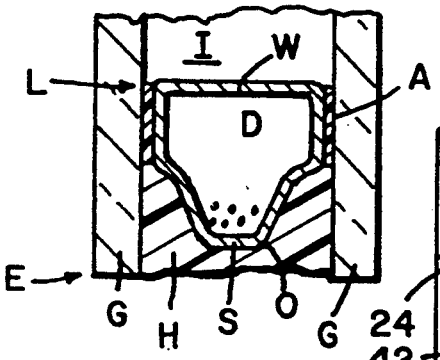
FIG. 1 is a cross sectional, broken-away view of a typical prior art insulating glass unit with spacer.

A glass unit of the prior art is shown in FIG. 1, spaced glass panes being shown as G and a spacer of aluminum being shown as S. Confronting surfaces of the panes are sealed to the spacer by means of a sealant A. Disposed within the channel defined by the spacer S are granules of a desiccant D. The spacer S is generally tubular in shape, with edges of the spacer being welded together at W along the center of the inner wall. Tiny perforations (not shown) are formed in the inner wall to permit gas in the interpane space I to come into contact with the desiccant. Another sealant H, which may be a silicone rubber, is disposed in the space defined by the outer wall O of the spacer and the confronting surfaces of the glass panes adjacent their peripheral edges, and provides another thermal path through which heat may be conducted from one pane to the other.

The prior art structure shown in FIG. 1 is quite rigid, and provides an "$R_{sp}$" value of about 0.06 to about 0.1 hr-ft$^2$-°F./Btu. As used herein, "$R_{sp}$" is a measure of the thermal resistance provided by the spacer and the sealant; $R_{sp}$ is the reciprocal of the thermal conductance $U_{sp}$ (measured in Btu/ft$^2$-hr-°F.), wherein the unit area represents an area measured along the periphery of the glass panes parallel to their planes and bounded on one side by the peripheral edge E of the pane and bounded on the other side by the upper edge L of the sealant (FIG. 1), L representing that point of attachment of the sealant to the glass panes that is spaced furthest from the edge E. As will be understood from the description that follows, the thermal resistance $R_{sp}$ of the spacer area of glass units of the invention ranges from about 0.3 to about 1.65 and preferably from about 0.4 to about 1.65 hr-°F.-ft$^2$/Btu.

Figure 2:
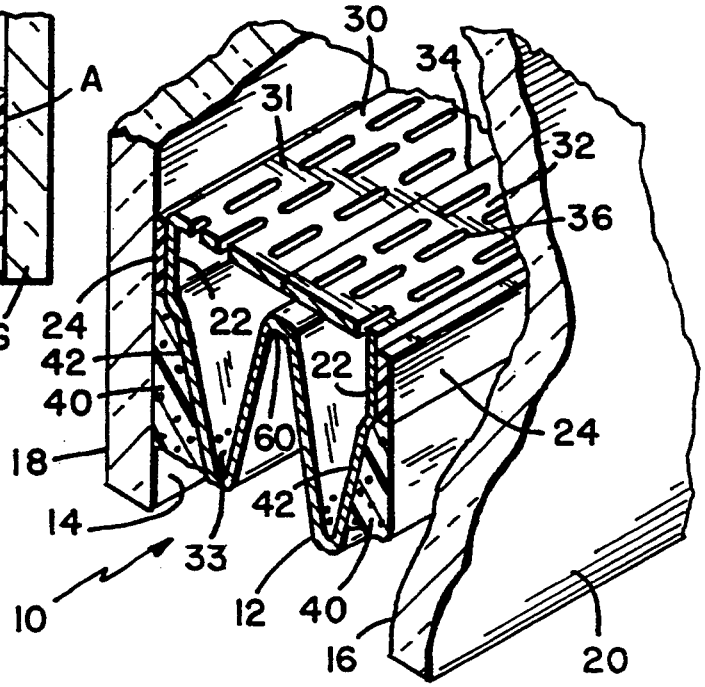
FIG. 2 is a perspective, broken-away view of an insulating glass unit of the invention showing the spacer element.

Referring now to FIG. 2, a spacer is designated generally as 10 and includes a first metal web 12 which extends substantially between the confronting surfaces 14, 16 of the spaced, parallel glass panes 18, 20. The web 12 in FIG. 2 is generally W-shaped in cross section, the arms of the W having flattened parallel edges 22 which form side walls bearing elongated strips 24 of a primary sealant such as polyisobutylene, the strips adhering the side walls to the confronting surfaces 14, 16 of the glass panes and forming, with the web, a web-sealant assembly. The web 12 is made of metal, desirably stainless steel or a magnesium alloy such as EZ-12B or EZ-92E, which metals, in comparison to aluminum, provide reduced thermal conductivity and also increased strength in thin sections.

The web 12 and the sealants sealing the web to the glass panes (including the primary sealant strips 24 and secondary sealant strips 40) define a first thermal path substantially spanning the distance between the panes, the thermal path having a thermal resistance (defined as the reciprocal of the thermal conductance measured in Btu/hour-foot of peripheral length-°F. temperature difference between the confronting surfaces of the panes) of at least about 8 hr-°F.-ft/Btu. For an interpane space 0.45 inches in width, the thermal resistance of the thermal path may be in the range of about 8 to about 11 hr-°F.-ft/Btu, and the thermal resistance for an interpane space 0.65 inches in width may range up to about 20 hr-°F.-ft/Btu.

Several factors may contribute to this high value of resistivity. One factor may involve the material from which the web is fabricated, it being taught above that stainless steel is a preferred material in terms of high strength and low thermal conductivity. The thinner the web is, of course, the less cross sectional area is available for heat transfer; hence, it is desirable to make the web as thin as practicable. Stainless steel webs having substantially uniform thicknesses in the range of about 0.004 to about 0.006 inches are preferred. A third factor involves the length of the thermal path between the panes defined by the web, and it will be noted that the web 12 in FIG. 2 may be formed to be generally W-shaped in cross section to increase the path length. Thermal path lengths on the order of at least about 0.4 inches or greater are desired, and path lengths ranging from about 0.04 to about 1.2 inches are preferred.

The web 12, although being highly resistant to the flow of heat from one pane to the other, must additionally be highly resistant to the permeation of air or other gas through it. The interpane space I often is filled with a moisture-free gas having a coefficient of thermal conductivity less than that of air. Argon, krypton and $SF_6$ are examples of appropriate gases that have been employed in the past. Although the interpane space may be maintained at approximately ambient atmospheric pressure, argon or other dry gas tends to permeate outwardly through the spacer-sealant assembly into the atmosphere, and atmospheric air tends to permeate through the spacer-sealant assembly and into the interpane space. The first or outer web 12 thus not only serves the function of thermally insulating the panes from each other, but, together with the sealant sealing it to the glass panes, also provides a highly impermeable peripheral seal which prevents more than negligible permeation of air or argon or other gas across the seal. It has been found that when the primary structure of the web 12 is of stainless steel or other metal or inorganic material (in comparison to a polymeric material such as a polyester), the primary leakage path of air or other gas occurs through the primary sealant strips 24; these strips accordingly are made as thin as possible (preferably not exceeding about 0.015 inches in thickness), the sealant strips having a width (measured perpendicular to the elongated strips 24 and in a plane parallel to that of the glass panes) of not less than about 0.13 inches. The web and primary sealant strips 24 provide a permeance to air and interpane space gas of not greater than about 0.06 cubic inches/year-inch of peripheral length-atm, and preferably not greater than about 0.03 cubic inches/-year-inch-atm.

The spacers employed in glass units of the invention may include separate structural support means to support the panes with respect to one another. In FIG. 2, the structural support means is provided by a wall 30 which, in the illustrated preferred embodiment, is formed integrally with the metal portion of the web 12, the wall 30 comprising flat web portions 31, 32 which extend from adjacent the confronting pane surfaces toward one another and are welded together along the weld line identified as 34 in FIG. 2.

In the embodiment shown in FIG. 2, the wall 30 provides a second web which substantially spans the distance between the panes and which has sufficient rigidity to structurally support the panes with respect to one another, particularly when the glass units are being fabricated. As shown in FIG. 2, the metal spacer may be formed integrally, that is, from a single metal strip by appropriate bending, hole-forming (e.g., piercing) and welding operations. The first web 12, which is generally W-shaped in cross section to provide a long thermal path between panes and which is formed of thin material to reduce the cross-sectional area available for heat flow, is often rather flexible due to its serpentine cross-sectional configuration so that it does not provide sufficient support by itself between the glass panes to prevent them from moving with respect to one another and thus placing substantial strain upon the primary sealant strips 24.

The second web defined by the wall 30 in the embodiment of FIG. 2, because of its generally flat configuration and connection to the first web 12, provides substantial rigidity between the glass panes. Since the first web 12 and primary sealant provide the spacer with sufficient impermeability to gas flow, the second web 30 does not need to be gas-impermeable but must, nonetheless, be exceedingly resistant to the flow of heat from one glass pane to the other. Indeed, the second thermal path provided by the second web 30 (which is in parallel with the thermal path provided by the web 12) has a thermal resistance at least about 2½ times and preferably at least about 5 times that of the web 12. The thermal resistance of the second web 30 desirably is above about 24 hr-°F.-ft/Btu and ranges from about 40 to about 120 hr-°F.-ft/Btu. In the preferred embodiment, thermal resistance is afforded by the formation of a series of openings through the second web, typified as staggered slots 36 in FIG. 2, the openings providing a tortuous path of reduced cross section for heat flow across the web and providing the web with a resistance to heat flow, as noted above, of at least about 2½ times that of the first path. The substantial thermal resistance thus obtained is a function not only of the reduced area available for heat flow due to the presence of the slots, but also the increased average path length (also resulting from the slots) for heat to travel across the web from one pane to the other. The slots may be formed by known machining techniques such as piercing and punching.

To provide increased rigidity and support to the glass unit, a secondary sealant, shown at 40 in FIG. 2, may be provided between the surfaces 14, 16 of the glass panes adjacent their periphery and the confronting surfaces of the peripherally converging arms 42 of the W-shaped web. The secondary sealant, as shown in FIG. 2, may be positioned solely between and in contact with the respective confronting surfaces of the peripherally converging arms 42 and the surfaces 14, 16 of the glass panes, the remainder of the outer surface of the web 12 being free of sealant 40. The sealant 40 can be any low thermal conductivity sealant, and silicone sealants such as General Electric 3211 and 1200 give good results.

The spacer-sealant assembly in FIG. 2, it will be noted, is devoid of any structure providing a second thermal path which has a thermal resistance less than at least about 2½ times and preferably less than about 5 times that provided by the first web 12. Thus, the path defined by the web 12 is the primary means of conduction of heat from one pane to the other, and in this manner, heat flow between the panes at their peripheries can be closely controlled.

The slots 36 formed in the second web also have the function of permitting gas in the interpane space to flow into and out of the generally hollow space defined by the exterior first web 12 and the second web 30, and a desiccant 33 may be placed in this space if desired.

Figure 3:
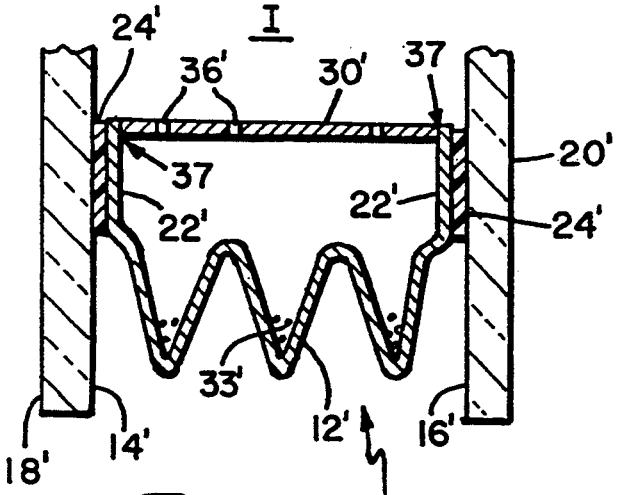
FIG. 3 is a cross sectional view of a modified embodiment of a glass unit of the invention.

Referring now to FIG. 3, similar identifying numerals, primed, are employed to designate structure corresponding to that shown in FIG. 2. The spacer employed between the panes 18, 20 of FIG. 3 includes a first web 12' having a slightly more convoluted serpentine configuration in cross section than the web 12 shown in FIG. 2. The side walls 22' of the web 12', as similarly shown in FIG. 2, have flat, parallel surfaces which are sealed to the confronting glass pane surfaces 14', 16' by primary sealant strips 24' of polyisobutylene or the like. A second web 30', which may be of the same material, e.g., a metal such as stainless steel, is appropriately slotted at 36' in the same manner as is shown in FIG. 2, the longitudinal edges of the web 30' being welded or otherwise rigidly connected, at 37, to the side walls 22 of the first web 12'. It will be understood that various mechanical connections between the webs 12' and 30' may be made. The longitudinal edges of the web 30', for example, may be bent downwardly (that is, toward the periphery of the glass unit) to either abut the side walls 22' of the first web or to overlie the walls 22' in surface-to-surface contact, the walls then being connected as by welding or the like (not shown).

Figure 4:
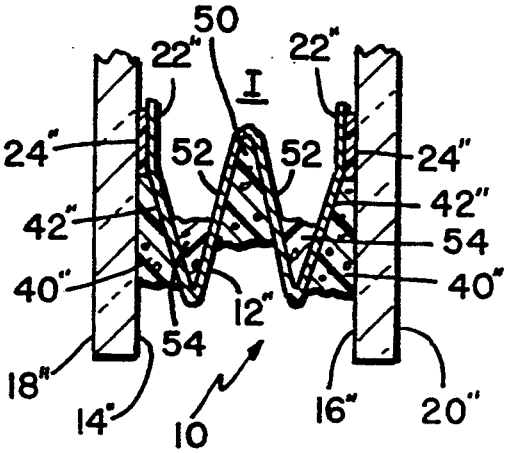
FIG. 4 is a cross sectional view of another embodiment of the invention.

Another embodiment of the glass units of the invention is shown in FIG. 4, the spacer 10'' of this embodiment having a first web 12'' similar in its W-shaped cross-sectional configuration to the spacer of FIG. 2. The upright arms of the "W" include side walls 22'' which, in a manner similar to that shown in FIGS. 2 and 3, are adhered to the glass pane inner surfaces 14'', 16'' by means of primary sealant strips 24'' of polyisobutylene rubber or the like. The spacer shown in FIG. 4 does not have a second, spaced web as do the spacers of the embodiments shown in FIGS. 2 and 3. Rather, additional structural support is provided by structural resinous or cementitious materials including secondary sealant 40'' (as described further below) located within the spaces between the confronting surfaces 14'', 16'' of the glass panes adjacent their peripheral edges and the peripherally converging arms 42'' of the web 12'', in a manner similar to that shown in FIG. 2. In addition, structural resinous materials 50 may be provided in the peripherally open, generally V-shaped recess formed by the central, peripherally divergent walls 52 of the web 12'', and the same or similar structural resinous materials may be provided in the interiorly open, V-shaped grooves defined by the walls 42 and 52, respectively, that are open to the interpane space, this resinous material being shown at 54 in FIG. 4. The latter material 54 may comprise a foamed silicone such as RTV-762 (General Electric), or another material offering sufficient structural rigidity, and may include a desiccant since the material 54 is exposed to the interpane space I. The structural material 54 desirably is free of components that are readily vaporized, to avoid contamination of the gaseous interpane environment.

The structural resinous materials 40'', 50, which may be the same or different, similarly offer sufficient structural rigidity as to enable the spacer to appropriately support the panes 18'', 20'' with respect to one another. It will be understood that the panes, in this manner, must be supported with respect to one another during manufacture, shipping and installation of the glass units, the units being eventually encased in a wooden or metal framework. It is important that the structural resinous materials 40'', 50 and 54 utilized in the embodiment of FIG. 4 be highly thermally insulative. In this manner, the thermal path between panes provided by the web 12'' and primary sealant strips 24'' remains the primary thermal path by which heat energy is transferred from one pane to the other adjacent the periphery of the glass unit, and there exists no second thermal path having a thermal resistance less than about 2½ times and preferably less than about 5 times that of the thermal path provided by the web 12''. It will be noted that the structural resinous materials 40'', 54, 50 as shown in FIG. 4 tend to overlap one another on opposite sides of the web 12'' for the purpose of offering structural strength to the spacer. It will be understood that as much or as little of these resinous materials will be employed as is needed to provide the necessary spacer strength; that is to say, the structural resinous materials in certain embodiments need not overlap as shown in FIG. 4.

The first webs 12', 12'' shown in FIGS. 3 and 4, respectively, which include the primary sealant strips 24', 24'' of polyisobutylene or the like, similarly exhibit the same excellent resistance to gas permeation therethrough as does the embodiment of FIG. 2; each exhibits a permeance to air and the interpane gas of not greater than about 0.06 cubic inches/year-peripheral inch-atmosphere (the latter referring the pressure difference across the webs of the partial pressure of air or interpane space gas; because the interpane space contains a gas other than air, this value is usually 1.0 atmosphere).

The spacer of the invention desirably but not necessarily is formed, as mentioned above, from stainless steel or other metal; in the preferred embodiment, the spacer is formed from a single elongated sheet or strip of stainless steel using conventional metal sheet forming techniques to provide a serpentine cross section in the first or outer peripheral web and conductivity-reducing slots in the second or interior web.

The spacers as described above extend substantially entirely along the periphery of the glass units. The spacer can be bent at the corners of the unit and its two ends joined as by welding to provide at least the first web portion with a hermetic seal. Alternatively, separately formed corner elements having cross sections similar to that shown in FIG. 2 can be used as inserts between straight portions of the spacer, the inserts being similarly joined to the straight portions by welding or the like.

In preparing the glass units of the invention, the formed metal spacer element 10 is provided with primary sealant strips 24 on its opposite side walls, the spacer being generally rectangularly configured so as to correspond to the glass panes to which it will be attached. The spacer is laid upon a horizontally disposed glass pane adjacent the peripheral edges of the pane and a second pane is then laid upon the spacer, the second and first panes thus becoming sealed to the spacer through the sealant strips 24. The air within the interpane space may be replaced with argon or other insulative gas through various methods known in the art, including the method shown in commonly assigned U.S. Pat. No. 4,780,164 issued Oct. 25, 1988. The supportive secondary sealant 40 is then provided between the facing glass surfaces 14, 16 and the confronting surfaces of the web arms 42 to provide further structural support to the glass unit and particularly to prevent the panes from being pulled away from the spacer. Except for the secondary sealant as thus described, the space bounded by the confronting surfaces of the panes adjacent their edges and exteriorly of the web 12 is preferably substantially free of sealant or other material that bridges that space. The outer surface of the web 12, accordingly, desirably is not covered by sealant but rather is exposed to the exterior of the glass unit, that is, to the atmosphere. The spacer 10 may be positioned relative to the peripheral edges of the panes, as shown in FIGS. 2–4, so that the outer surface of the metal web 12, which is not covered by sealant, is spaced inwardly from the peripheral edges of the panes.

Although glass units of the invention have been described and illustrated as two pane units, the glass units may contain three or more panes, the spacer-sealant assembly of the invention being provided between one or more pairs of confronting pane surfaces and preferably between each pair of confronting pane surfaces.

While a preferred embodiment of the present invention has been described, it should be understood that various changes, adaptations and modifications may be made therein without departing from the spirit of the invention and the scope of the appended claims.

What is claimed is:

1. An insulating glass unit comprising a pair of generally parallel, spaced-apart glass panes having confronting surfaces and peripheral edges, and a spacer-sealant assembly peripherally joining the glass panes to one another, the panes and spacer-sealant defining between them a gas-containing interpane space, the spacer-sealant including a first metal web substantially spanning the distance between the panes, the first metal web having an outer surface with a middle section between the panes and arm portions which in cross section have peripherally convergent outer surfaces; a sealant including a primary sealant sealing edges of the first web to confronting surfaces of the panes and a secondary, supportive sealant positioned solely between the outer surfaces of the arm portions and the respective confronting surfaces of the panes so that the middle section of the outer surface of the first web is free of secondary sealant; and wherein the first web and sealant provide a barrier having a permeance to air and interpane space gas of not greater than about 0.06 cubic inches/yr-inch-atm., the first web being of stainless steel having a substantially uniform thickness of not greater than about 0.006 inches to define a first thermal path between the panes having a thermal resistance of at least about 8 hr-°F.-ft/Btu.

2. The glass unit of claim 1, wherein the first web has a thermal path length between the panes of at least 0.4 inches.

3. The glass unit of claim 1, wherein the first web has a serpentine cross-sectional configuration.

4. The glass unit of claim 1, wherein the first web is spaced inwardly from the peripheral edges of the panes.

5. An insulating glass unit comprising a pair of generally parallel, spaced-apart glass panes having confronting surfaces and peripheral edges, and a spacer-sealant assembly peripherally joining the glass panes to one another, the panes and spacer-sealant defining between them a gas-containing interpane space, the spacer-sealant including a first metal web substantially spanning the distance between the panes, the first metal web having an outer surface with a middle section between the panes and arm portions which in cross section have peripherally convergent outer surfaces; a sealant including a primary sealant sealing edges of the first web to confronting surfaces of the panes and a secondary, supportive sealant positioned solely between the outer surfaces of the arm portions and the respective confronting surfaces of the panes so that the middle section of the outer surface of the first web is free of secondary sealant; and a second web substantially spanning the distance between the panes and spaced inwardly from the first web; wherein the first web and sealant provide a barrier having a permeance to air and interpane space gas of not greater than about 0.06 cubic inches/yr-inch-atm., the first web being of stainless steel having a substantially uniform thickness of not greater than about 0.006 inches to define a first thermal path between the panes having a thermal resistance of at least about 8 hr-°F.-ft/Btu.

6. The glass unit of claim 5, wherein the first web has a serpentine cross-sectional configuration.

7. The glass unit of claim 5, wherein the outer surface of the first web is spaced inwardly from the peripheral edges of the panes.

8. An insulating glass unit comprising a pair of generally parallel, spaced-apart glass panes having confronting surfaces, and a spacer-sealant assembly peripherally joining the glass panes to one another, the panes and spacer-sealant assembly defining between them a gas-containing interpane space, the spacer-sealant assembly including a first metal web substantially spanning the distance between the panes and having in cross section a serpentine configuration with peripherally convergent arms having outer surfaces that confront surfaces of the respective glass panes and a middle section between the arms, a sealant sealing edges of the first web to confronting surfaces of the panes and including a supportive sealant positioned solely between the outer surfaces of the arm portions and the respective confronting surfaces of the panes so that the middle section of the outer surface of the first web is free of secondary sealant; and a second web substantially spanning the distance between the panes and being spaced inwardly from the first web; wherein the first web and sealant provide a barrier having a permeance to air and interpane space gas of not greater than about 0.06 cubic inches/yr-inch-atm., the first web being of stainless steel having a substantially uniform thickness of not greater than about 0.006 inches and a thermal path length of at least 0.4 inches between the panes to define a first thermal path between the panes having a thermal resistance of at least about 8 hr-°F.-ft/Btu.

9. An insulating glass unit comprising a pair of generally parallel, spaced-apart glass panes having peripheral edges and confronting surfaces, and a spacer-sealant assembly peripherally joining the glass panes to one another, the panes and spacer-sealant assembly defining between them a gas-containing interpane space, the spacer-sealant assembly including a first metal web substantially spanning the distance between the panes, the first metal web having a serpentine cross section, a middle section between the panes, and arm portions which in cross section have peripherally convergent outer surfaces; a sealant including a primary sealant sealing edges of the first web to confronting surfaces of the panes and a secondary, supportive sealant positioned solely between the arm portions and the respective confronting surfaces of the panes, the middle section of the first web having an outer surface free of secondary sealant, and a second web substantially spanning the distance between the panes and being spaced inwardly from the first web, the first web and sealant providing a barrier having a permeance to air and interpane space gas of not greater than about 0.06 cubic inches/yr-inch-atm., the first web being of stainless steel having a substantially uniform thickness of not greater than about 0.006 inches and a thermal path length of at least 0.4 inches between the panes, the central portion of the first web being spaced inwardly of the peripheral edges of the pane and the first web defining a thermal path between the panes having a thermal resistance of at least about 8 hr-°F.-ft/Btu.

* * * * *

UNITED STATES PATENT AND TRADEMARK OFFICE

CERTIFICATE OF CORRECTION

PATENT NO. : 5,377,473

DATED : 03 January 1995

INVENTOR(S) : Nilabh Narayan and James E. Larsen

It is certified that error appears in the above-identified patent and that said Letters Patent is hereby corrected as shown below:

Title page item [73], Assignee's residence, please rewrite "Michigan" as --Minnesota--.
Col 4, Line 27, delete "0.04" and insert --0.4--.
Col 4, Line 59, after length-atm, delete "," and add --.--.

Signed and Sealed this

Twenty-sixth Day of September, 2000

*Attest:*

Q. TODD DICKINSON

*Attesting Officer*

*Director of Patents and Trademarks*